US005217586A

United States Patent [19]

Datta et al.

[11] Patent Number: 5,217,586

[45] Date of Patent: Jun. 8, 1993

[54] ELECTROCHEMICAL TOOL FOR UNIFORM METAL REMOVAL DURING ELECTROPOLISHING

[75] Inventors: Madhav Datta, Yorktown Heights; Lubomyr T. Romankiw, Briarcliff Manor, both of N.Y.

[73] Assignee: International Business Machines Corporation, Armonk, N.Y.

[21] Appl. No.: 819,298

[22] Filed: Jan. 9, 1992

[51] Int. Cl.[5] ..... C25F 3/16; C25F 7/00

[52] U.S. Cl. ..... 204/129.6; 204/129.9; 204/129.95; 204/224 M

[58] Field of Search ..... 204/129.55, 129.65, 204/224 M, 129.9, 129.95, 129.6

[56] References Cited

U.S. PATENT DOCUMENTS

| | | | |
|---|---|---|---|
| 2,868,705 | 1/1959 | Baier et al. | 204/140.5 |
| 3,240,685 | 2/1962 | Maissel | 204/129.5 X |
| 3,325,384 | 6/1967 | Frantzen | 204/129.55 |
| 3,713,998 | 1/1973 | Kenney | 204/224 M |
| 4,127,459 | 11/1978 | Jumer | 204/129.5 |
| 4,247,377 | 1/1981 | Eckler et al. | 204/129.65 |
| 4,303,482 | 12/1981 | Bühne et al. | 204/129.65 X |
| 4,548,685 | 10/1985 | Suemitsu et al. | 204/146 |
| 4,882,019 | 11/1989 | Lewy | 204/129.1 |

*Primary Examiner*—Donald R. Valentine
*Attorney, Agent, or Firm*—Scully, Scott, Murphy & Presser

[57] ABSTRACT

The present invention relates to an electropolishing tool for the removal of metal from a workpiece, said electropolishing tool comprising a container means for retaining an electrolytic solution, a cathode assembly in the shape of a pyramid the height of which is adjustable, a power supply means including a negative terminal and a positive terminal with said negative terminal being electrically connectable to said cathode assembly, a plate means for holding the workpiece and for forming an electrical connection to the workpiece, said plate means connected to the positive terminal of said power supply means, and an enclosure means placed over the workpiece leaving only the surface of the workpiece which is to be polished exposed to the electrolytic solution such that when the workpiece is secured to said plate means and said cathode assembly is connected to the negative terminal of said power supply means and is placed over the said enclosure means directly facing the workpiece enclosed therein, that portion of the workpiece exposed to the electrolytic solution undergoes electropolishing.

20 Claims, 1 Drawing Sheet

ELECTROCHEMICAL TOOL FOR UNIFORM METAL REMOVAL DURING ELECTROPOLISHING

TECHNICAL FIELD

The present invention relates to an electrochemical tool to be used for the removal of thin film metal during the process of electropolishing. More particularly, the present invention describes an apparatus and technique for uniform metal removal during the planarization of a double layer metallurgy (DLM) structure by electropolishing. The present invention is applicable to the planarization of multilayer copper interconnection for thin film modules of varying sizes and shapes. The metal is electrochemically etched from a substrate as part of a manufacturing procedure for multilayer thin film wiring.

PRIOR ART

The process of micromilling is a well documented conventional method used for the mechanical polishing of various workpieces. Although the process of micromilling is presently being employed for the planarization of DLM structures, it has several disadvantages which are associated with its use. To begin with, problems exist relating to the alignment and the levelling of the parts to be micromilled. Secondly, induced stresses created by the process lead to problems of cracking and delamination of the workpiece. In addition, there exists the possibility of the contamination of the dielectric layer with copper due to the smearing action which takes place during the process of micromilling. Furthermore, the micromilling technique involves high capital investment while the operation itself is labor intensive with potential yield problems.

An alternate cost effective planarization technique to that of micromilling is the method of electropolishing. Electropolishing is a technique which can produce smooth surfaces on a variety of metals through the use of electrochemical means. Copper and its alloys, stainless steel, steel, brass, aluminum, silver, nickel chromium, zinc, gold and many other alloys may be electropolished. Electropolishing as a means of metallographic specimen preparation is a process that has been gaining increasing acceptance due to a number of distinct advantages which the process has over mechanical polishing. These advantages include the rapidity at which the workpiece or specimen may be polished, the elimination of cold-worked surfaces, the ultimate flatness of the polished area and the fact that the electropolishing step can often be accomplished in one and the same operation with an etching step. In addition, as stated above, the process of electropolishing can be applied to a wide variety of metals and alloys.

Electropolishing relates to the art of electrolytically treating metal to clean, level, smooth, polish and/or protect the surface thereof. Through the use of electrolytic action, the process of electropolishing removes minute projections and irregularities on the surface of a specimen. Essentially, electropolishing is the reverse of the process of electroplating. In the vast majority of electroplating processes, metal (and hydrogen) are deposited on the cathode and dissolved from the anode. In electropolishing, on the other hand, the workpiece is made the anode and tends to be dissolved. Electropolishing equipment usually consists of a polishing cell which contains a circulating pump and the electrolytic solution, and a filtered DC power source. Depending upon the application, however, the electropolishing process may or may not involve pumping of the electrolyte. Although pumping is required to remove reaction products from the surfaces of the anode and cathode, in some cases pumping of the electrolyte may introduce hydrodynamic instabilities which in turn may lead to localized non-uniform metal dissolution. In the majority of applications found in the literature, electropolishing has been used for the finishing of large parts where non-uniformities up to the levels of microns have not been a matter of concern. Consequently, the pumping of the electrolyte has been effectively used as a means of enhancing reaction product removal in the electropolishing process.

In accordance with the most accepted theory behind the process of electropolishing, the high points of the metal surface are those which are most readily oxidized as the electric current density is higher at the projections located on the specimen. In a relatively short amount of time, the oxidized material is then thereupon dissolved in the electrolyte or otherwise removed from the surface, resulting in the disappearance of any irregularities which had existed on the surface. In any event, the selective solution of the high points of the metal surface tend to produce a smooth finish which is comparable or superior to the mechanically buffed surface afforded by the micromilling technique. It is also noted that all mechanical methods of polishing, including those used for metallographic samples, produce a thin surface layer of work-hardened metal. Electropolishing, on the other hand, provides a stain-free surface which is especially suitable for obtaining microscopically flat surfaces.

Going back to the theory behind the process, it is believed that in the anodic treatment of metals, a viscous layer or film of high electrical resistivity is formed on the surface of the anode being treated during the passage of current through the electrolyte. Because the electrolyte is of comparatively low electrical resistance, the formation of a layer of comparatively high resistance on the anode surface causes the anodic potential in the different regions of the surface being treated to vary according to the extent to which these regions project into said layer. This in turn causes the salient points on the surface of the specimen to fuse at a rate according to their depth, thereby levelling off said points until an equipotential condition is attained over the surface. It is at this latter stage that the surface of the workpiece will be levelled and smoothed off.

There are a number of variables in the process of electrolytic polishing. They include current density (or voltage), time, temperature and choice of electrolyte. The determination of these parameters require actual laboratory tests. The optimum parameters for a particular process will depend a great deal on the metal which is to be electropolished. For example, a wide variety of electrolytes may be used for the electropolishing process per se. Highly concentrated solutions of sulfuric and/or phosphoric and/or chromic acids are used frequently for electropolishing. A typical electrolyte for stainless steel contains phosphoric acid and butyl alcohol. Phosphoric acid based electrolytes can also be effectively used for the electropolishing of copper (see W. J. McTegart, "The Electrolytic And Chemical Polishing Of Metals", Pergamon Press, London (1956)).

For various examples of the electropolishing process, see U.S. Pat. Nos. 2,868,705; 4,127,459; and 4,882,019. Although these references involve the conventional process of electropolishing, they are related to methods and apparatus for polishing large parts. By choosing a suitable electrolyte and electrochemical parameters, the skilled artisan can obtain high speed metal removal from a surface to provide a microfinished surface. However, in order for the process of electropolishing to be effectively employed in thin film planarization work, a particular concern has to be the non-uniform removal of metal which may occur during the process.

SUMMARY OF THE INVENTION

The present invention relates to an electropolishing tool for the removal of metal from a workpiece, said electropolishing tool comprising a container means for retaining an electrolytic solution; a cathode assembly having a pyramid-like form or shape, the height of which is adjustable; a power supply means including a negative terminal and a positive terminal, said negative terminal being electrically connectable to said cathode assembly; a plate means for holding the workpiece and for forming an electrical connection to the workpiece, said plate means connected to the positive terminal of said power supply means; and an enclosure means placed over the workpiece leaving only the surface of the workpiece which is to be polished exposed to the electrolytic solution such that when the workpiece is secured to said plate means and said cathode assembly is connected to the negative terminal of said power supply means and said cathode assembly is placed opposite the said enclosure means directly facing the workpiece enclosed therein, that portion of the workpiece exposed to the electrolytic solution undergoes electropolishing.

The present invention also relates to a method for electropolishing of a workpiece comprising the steps of mounting a workpiece on a plate means in a container filled with a stationary electrolytic solution; positioning a cathode assembly opposite to and facing towards the workpiece, the cathode assembly being in the shape of pyramid the height of which is adjustable; making the sample and said cathode assembly respectively an anode and cathode in an electrical circuit; placing an enclosure means over the workpiece leaving only the surface of the workpiece which is to be polished exposed to the electrolytic solution; and continuously conducting an electric current through the electrical circuit under conditions effective to electropolish the surface of the workpiece.

The present invention employs two preferred variations of the cathode assembly. In the first embodiment, the cathode assembly consists of rings or plates that are fixed one above the other to form the pyramid-like shape described above. In the second embodiment, the cathode assembly is comprised of a conically-shaped structure. In addition, two methods are described for determining the end-point of the electropolishing process for planarization.

DETAILED DESCRIPTION OF THE PREFERRED EMBODIMENT OF THE INVENTION

Figure 1:
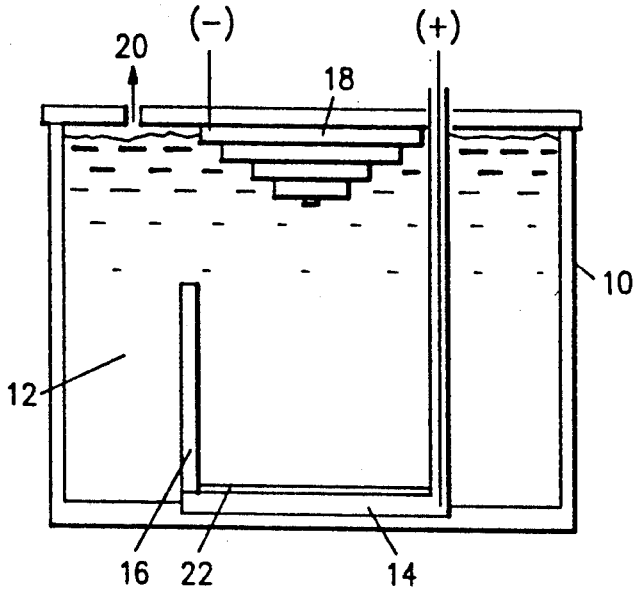
FIG. 1 is a schematic drawing of the electrochemical tool of the subject invention for the uniform removal of metal during the electropolishing process.

Electropolishing is the anodic removal of metal from a workpiece and involves the generation of metal ions at the surface thereof. The reaction can be represented by the following equation:

$$M \rightarrow M^{z+} + Xr^{-}$$

As the current is increased, the rate of metal ion generation increases. These metal ions are then transported from the anodic surface of the workpiece into the bulk electrolyte. In electrochemical systems, transport processes involve migration, diffusion and convection. When dealing with a strong electrolyte, the migration and convection effects are negligible at the anodic surface. Consequently, electropolishing takes place under conditions when the metal dissolution reaction is diffusion controlled. That is, the transport of the material under these conditions mainly takes place by diffusion. This "mass transport" takes place such that a concentration gradient of metal ions occur near the anodic surface. This layer is known as the diffusion layer. The electropolishing occurs under conditions when the metal dissolution process reaches its limiting value (due to the exceeding of the solubility limit) such that a salt film is formed.

The tool and the method of the present invention involves the electropolishing of thin films in which uniformity is desired at the micron level. This requires making sure that a viscous layer of uniform thickness is present at the surface as the formation of a uniformly distributed surface film over the workpiece is a key factor to obtaining uniform metal removal during electropolishing. Besides the ability to form a uniform viscous layer, other key factors which determine the uniformity of metal removal during the process of electropolishing include maintaining a uniform solution composition as well as solution resistance. In a parallel plate electrolytic cell, the metal dissolution at the edges of a workpiece is much higher than at the center due to the lack of uniformity of the above-mentioned parameters.

It is also important to note that during the process of electropolishing and depending upon the chosen operating conditions, hydrogen gas evolves at the cathode while oxygen gas may evolve at the anode. Under the work conditions employed by the present invention (i.e. current ranging from 5 to 10 Amps), oxygen gas evolution is at a minimum. This not only ensures high metal removal efficiency but also minimizes instabilities at the surface due to oxygen bubbles that may grow and detach thus causing hydrodynamic instabilities due to bubble dynamics. In a similar fashion, interference from the evolution of hydrogen gas at the cathode also needs to be eliminated. By positioning the cathode assembly above the anode sample, any hydrogen bubbles formed will move upwards through the electrolyte and not disturb the sample positioned below it. Also, using a cathode assembly in the form of a pyramid allows for the easy escape of any hydrogen gas and minimizes the disturbance of the stable hydrodynamic situation.

In the electropolishing tool of the present invention, variations in these parameters at the surface of the workpiece can be minimized or eliminated altogether. Metal dissolution uniformity is achieved by the present invention through the use of a cathode assembly of the shape of a pyramid the height of which can be adjusted and through the use of an enclosure over the workpiece to ensure the establishment of stationary conditions and to minimize current concentration at the edges.

FIG. 1 schematically shows the electropolishing tool of the present invention. It consists of a container means (10) which is filled with the electrolyte (12). Workpiece (22) is fixed on a plate means (14) connected to the positive terminal of a power supply means. An enclosure means (16) is properly placed over the workpiece (22) such that only the surface that is to be planarized is exposed to the electrolyte (12). The electrolyte (12) within the enclosures means (16) is stationary. This particular arrangement achieves three goals. First, the hydrodynamic instabilities at the dissolving anode are minimized. Second, the current concentration at the edges of the workpiece are also minimized and third, the arrangement described hereinabove ensures the formation of a viscous layer. A vent (20) is also present for the escape of gases which may form during the electropolishing method.

Figure 2A:
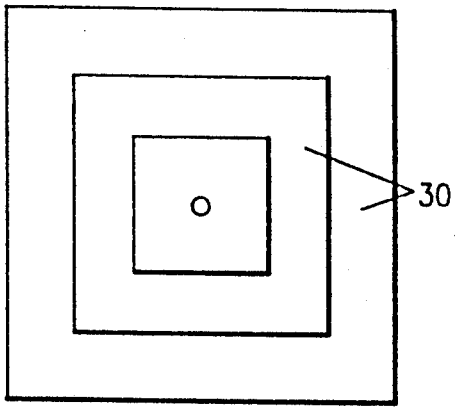
FIG. 2*a* is a bottom view of the cathode assembly of the tool of the subject invention consisting of plates that are fixed one above the other to form a pyramid-like shape.
Figure 2B:
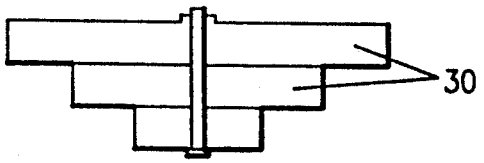
FIG. 2*b* is a side view of the cathode assembly of FIG. 2*a*.
Figure 2C:
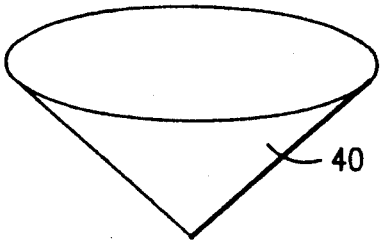
FIG. 2*c* is a side view of the cathode assembly of the tool of the subject invention having a conically-shaped configuration to form the pyramid-like structure.

The cathode assembly (18) shown in FIG. 1 is placed opposite the enclosure means (16) directly facing the workpiece (14). The cathode assembly (18) consists of rings or plates (30) that are fixed one above the other as shown in FIGS. 2*a* and 2*b*. This type of pyramid structure compensates for possible current concentration at the edges. As illustrated in FIG. 2*c*, another embodiment of the cathode assembly may be in the form of a circular cone (40). The rings and/or plates or circular cone should be constructed of a material which is substantially corrosion resistant to the electrolyte and which will not be damaged by the electrolyte. For a phosphoric acid electrolyte, stainless steel and nickel are preferable materials. The size and the number of rings/plates required to get optimum results can be determined experimentally or can be determined by mathematical modeling. One being of ordinary skill in the art would appreciate that the size of the rings/plates will depend on the size of the workpiece being polished. The thickness of the rings will depend on the current distribution as determined by the properties of the electrolyte being used, i.e. concentration, conductivity, etc., and the metal dissolution reaction rate at different locations of the sample. Generally, the cathode assembly made of rings or plates will consist of two to six rings or plates, of uniform thickness and decreasing diameter.

The container means, the plate means and the enclosure means can be constructed of PVC as this material can withstand acids very well, is less expensive than other materials, and is easy to machine. However, similar materials can be used such as teflon, glass, PVDF, and the like.

The present invention is useful for the electropolishing of thin films of almost any material that is electrically conducting (including conducting ceramics). The electrochemical tool described herein is ideal to obtain uniform current distribution during the planarization of multilayer copper interconnection for thin film modules of varying sizes and shapes. For such an application, two different methods may be easily employed for the determination of the end-point of the electropolishing for planarization. As the electrochemical tool of the present invention employs conditions which result in the uniform metal removal over the entire workpiece, the end point can be easily determined by coulometry. The coulometric method may involve electropolishing up to a point at which 0.5 to 1 micron of copper is left which can then be removed by "kiss polishing" (very short duration mechanical or chemical-mechanical polishing.

A second method in determining the endpoint of electropolishing for planarization is to tailor the bath chemistry to include small concentrations of nitric acid such that the last layers of copper can be removed after current stoppage by chemical etching.

The following example is provided to further illustrate the present invention.

EXAMPLE 5 inch diameter silicon wafers plated with 20 micron thick copper were electropolished using the electropolishing tool of the present invention. The thickness of the plated material before and after electropolishing was determined by a four point probe, i.e. an instrument which measures thickness by measuring the effective resistance of the material. Through the use of this method, uniformity of metal removal by electropolishing was determined. Constant current experiments were performed using concentrated phosphoric acid as the electrolyte and current ranging between about 5 and about 40 Amps (or current density ranging between about 40 and about 320 $mA/cm^2$). Operating at low currents resulted in better uniformity and better current efficiency for metal dissolution. At high currents, oxygen evolution occurred simultaneously with metal dissolution. Consequently, current efficiency for metal removal at high currents was significantly low. Optimum results were obtained at a current from about 5 to about 10 Amps (or at a current density from about 40 to about 80 $mA/cm^2$).

The time of operation at a given current can easily be estimated from Faraday's Law, which for a given material and operating conditions, varies linearly with the thickness of the metal to be dissolved. Cell voltage during constant current operation depended on the concentration of the electrolyte (i.e., its conductivity) and the anode-cathode spacing. It was found that concentrated phosphoric acid (85%) was preferable as lower concentrations of acid resulted in the evolution of more oxygen under otherwise similar conditions.

With respect to the cathode assembly, ring thickness of one inch each and three rings of different diameters (5 inches, 3 inches and 1 inch) were used and the cathode-anode separation was maintained at a minimum of 3 inches. It should be noted that a relatively larger anode-cathode distance is not desirable as it would require higher cell voltage and consequently higher power consumption. A very small interelectrode spacing, on the other hand, will lead to interferences from anodic and cathodic reaction products. The stack of rings was later replaced by a circular cone cathode assembly which was two inches in height and had a five inch diameter. One skilled in the art will understand that the dimensions of the cone will vary according to the sample size. It was found that the circular cone cathode assembly was easier to install and resulted in better uniformity. It also helped in the easy escape of hydrogen gas bubbles which were generated at the cathode.

While the invention has been particularly shown and described with respect to a preferred embodiment thereof, it will be understood by those skilled in the art that the foregoing and other changes in form and details may be made therein without departing from the spirit and scope of the invention.

Having thus described our invention, what we claim as new, and desire to secure by Letters Patent is:

1. An electropolishing tool for the removal of metal from a workpiece, said electropolishing tool comprising:

a container means for retaining an electrolytic solution;

a cathode assembly positionable within said container means, said cathode assembly being in the form of a pyramid shape the height of which is adjustable;

a power supply means including a negative terminal and a positive terminal, said negative terminal being electrically connectable to said cathode assembly;

a plate means for holding the workpiece and for forming an electrical connection to the workpiece, said plate means connected to the positive terminal of said power supply means; and an enclosure means positioned within said container means, said enclosure means adapted to enclose said workpiece and to contain a portion of electrolyte solution to be placed in said container means such that only the surface of the workpiece to be polished will be exposed to electrolytic solution when said solution is placed in said container means and said electrolytic solution when contained in said enclosure means remains stationary during operation of said tool, and such that said cathode assembly is positioned to directly face the workpiece when enclosed in said enclosure means.

2. The electropolishing tool according to claim 1 wherein said cathode assembly consists of rings or plates that are fixed one above the other to form a pyramid shape the height of which is adjustable.

3. The electropolishing tool according to claim 2 wherein the rings or plates are made of stainless steel.

4. The electropolishing tool according to claim 2 wherein the rings or plates are made of nickel.

5. The electropolishing tool according to claim 2 wherein the cathode assembly consists of two to six rings, of uniform thickness and decreasing diameter.

6. The electropolishing tool according to claim 1 wherein said cathode assembly is in the form of a circular cone.

7. The electropolishing tool of claim 6 wherein said circular cone cathode assembly is made of stainless steel.

8. The electropolishing tool of claim 6 wherein said circular cone cathode assembly is made of nickel.

9. The electropolishing tool of claim 1 wherein said container means, said plate means and said enclosures means are made of PVC.

10. The electropolishing tool of claim 1 wherein said container means is made of glass.

11. A method for electropolishing a workpiece comprising the steps of:

mounting a workpiece on a plate means in a container filled with an electrolytic solution;

positioning a cathode assembly over and facing towards the workpiece, the cathode assembly being in the shape of a pyramid, the height of which is adjustable;

making the sample and said cathode assembly respectively an anode and cathode in an electrical circuit;

positioning an enclosure means within said container means such that only the surface of the workpiece which is to be polished is exposed to the electrolytic solution, said electrolytic solution contained in said enclosure means remaining stationary during the electropolishing method; and continuously conducting an electric current through the electrical circuit under conditions effective to electropolish the surface of the workpiece exposed to the electrolytic solution.

12. A method according to claim 11 wherein the electrolytic solution comprises phosphoric acid.

13. A method according to claim 12 wherein the phosphoric acid electrolytic solution is 85% phosphoric acid.

14. A method according to claim 11 wherein the current density ranges from about 40 to about 320 $mA/cm^2$.

15. A method according to claim 11 wherein the current density ranges from about 40 to about 80 $mA/cm^2$.

16. A method according to claim 11 wherein the cathode assembly consists of rings or plates that are fixed one above the other to form a pyramid shape.

17. A method according to claim 16 wherein the cathode assembly consists of two to six rings or plates of uniform thickness and decreasing diameter.

18. A method according to claim 11 wherein the cathode assembly is in the form of a circular cone.

19. A method according to claim 11 wherein the workpiece is a thin film module.

20. A method according to claim 11 wherein the workpiece is a double layer metallurgy structure.

* * * * *

UNITED STATES PATENT AND TRADEMARK OFFICE

CERTIFICATE OF CORRECTION

PATENT NO. : 5,217,586

DATED : June 8, 1993

INVENTOR(S) : Madhav Datta, et al.

It is certified that error appears in the above-identified patent and that said Letters Patent is hereby corrected as shown below:

Column 4, line 15: " $M \longrightarrow M^{z+} + Xr^{-}$ "

should read -- $M \longrightarrow M^{z+} + Ze^{-}$ --

Signed and Sealed this

Third Day of May, 1994

Bruce Lehman

*Attest:*

BRUCE LEHMAN

*Attesting Officer*

*Commissioner of Patents and Trademarks*